US006582069B2

(12) United States Patent
Ohashi et al.

(10) Patent No.: US 6,582,069 B2
(45) Date of Patent: Jun. 24, 2003

(54) INK-JET RECORDING HEAD AND RECORDING APPARATUS

(75) Inventors: Tetsuya Ohashi, Chiba (JP); Yutaka Koizumi, Kanagawa (JP); Hiroyuki Kigami, Kanagawa (JP); Satoshi Shimazu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/941,775

(22) Filed: Aug. 30, 2001

(65) Prior Publication Data

US 2002/0033868 A1 Mar. 21, 2002

(30) Foreign Application Priority Data

Sep. 4, 2000 (JP) ..... 2000-267798

(51) Int. Cl.[7] ..... B41J 2/175
(52) U.S. Cl. ..... 347/94
(58) Field of Search ..... 347/84, 85, 92, 347/94

(56) References Cited

U.S. PATENT DOCUMENTS

| | | | | |
|---|---|---|---|---|
| 5,682,190 A | | 10/1997 | Hirosawa et al. | 347/94 |
| 6,109,734 A | * | 8/2000 | Kashino et al. | 347/94 |
| 6,241,350 B1 | | 6/2001 | Otsuka et al. | 347/94 |
| 2002/0071015 A1 | * | 6/2002 | Kaga et al. | 347/94 |

FOREIGN PATENT DOCUMENTS

| | | | |
|---|---|---|---|
| EP | 1078760 A2 * | 2/2001 | B41J/2/14 |
| JP | 6-210872 | 8/1994 | |

* cited by examiner

*Primary Examiner*—Huan Tran
(74) *Attorney, Agent, or Firm*—Fitzpatrick, Cella, Harper & Scinto

(57) ABSTRACT

There is provided an ink-jet recording head comprising a printing head unit which has one or more discharge portions for discharging one or more types of fluids for printing, a tank holder unit in which one or more tanks for storing one or more types of fluids to be discharged by the printing head unit are loaded, and a fluid supply path which is formed in the tank holder unit and communicates with the printing head unit and the tank, wherein a buffer chamber for keeping gas is connected to the fluid supply path.

8 Claims, 9 Drawing Sheets

INK-JET RECORDING HEAD AND RECORDING APPARATUS

BACKGROUND OF THE INVENTION

1. Field of the Invention

The present invention relates to an ink-jet head which does printing on a printing medium such as paper or cloth by discharging ink, and a printing apparatus using the head.

2. Related Background Art

A printing apparatus such as a printer, copier or facsimile is constituted such that it prints a dot-pattern image on a printing material based on image information. The above printing apparatuses can be classified into an ink-jet system, a wire dot system, a thermal system, a laser beam system and the like, according to printing system thereof. Of these, the ink-jet system has an ink-jet head, and the head has an energy conversion means for generating discharge energy used for discharging ink to a fluid path. The head is constituted such that it leads ink from an ink supply port to the above fluid path via a fluid chamber, jets the ink toward a printing material as flying droplets by the discharge energy given by the energy conversion means and does printing by the ink droplets struck the printing material. Of these, an ink-jet head which discharges ink by using thermal energy has been practically used since it has such advantages that ink discharge ports for forming flying droplets by discharging ink droplets for printing can be arranged at high densities and that a reduction in the overall size thereof can be easily done. In addition, in recent years, the number of nozzles arranged in the ink-jet head has been increasing in response to the demand for high-speed printing.

However, since the ink-jet system deals with fluid ink, the meniscus vibrations in the discharge nozzles are greatly disturbed by the vibration of the ink, whereby deterioration in the quality of an image may occur. Particularly, in the case of an ink-jet head having a number of nozzles arranged at high densities therein, since the amount of ink moving per unit of time is large, the inertial force of the ink in a tank system which works to move the ink forward (toward the head) when the discharge of the ink is ceased also become large. Because of this inertial force, a positive pressure is exerted on the nozzle, whereby meniscus is protruded. When the following print signal comes in at this point, small ink droplets are splashed and so-called "splashed" printing results.

FIG. 12 is a graph showing the vibration waveform of the pressure in an ink flow path to a discharge pulse when a predetermined discharge is made by an ink-jet head. FIGS. 13A, 13B and 13C are cross-sectional view of a nozzle showing the states of meniscus in the section A (before discharge), the section B (during discharge) and the section C (immediately after discharge stop). As shown in FIG. 12, the amplitude a of the vibration of the pressure in a flow path after discharge stop is large and the pressure in the flow path is a positive pressure, and this vibration disturbs meniscus vibration at the next discharge. Specifically, in the section A in FIG. 12, a stable meniscus M is formed as shown in FIG. 13A. When discharge is made (or heating element 53 is pulse-driven) as in the section B with the meniscus M in this state, a good droplet 50 is produced as shown in FIG. 13B. Then, in the section C immediately after the discharge, the pressure in a flow path 52 is greatly inclined to a positive pressure by the inertia of a fluid moving toward a discharge port 51, and the meniscus M is formed in such a state that it protrudes from the discharge port as shown in FIG. 13C and, at the worst, ink drips from the discharge port 51. Therefore, as described above, when the discharge of ink is resumed in the state of FIG. 13C, small ink droplets are splashed and a good image cannot be formed.

As a method for overcoming such phenomena, it is practiced that flow resistance is adjusted by altering the diameter of a filter or the flow path of ink so as to control the meniscus vibration. However, when the flow resistance is set to be large, a sufficient supply (refill) of ink will not be able to be provided to discharge nozzles eventually and a sufficient discharge amount cannot be obtained at the time of discharge, thereby causing insufficient concentration. On the other hand, when the flow resistance is set to be small, a sufficient supply of ink can be provided but the amplitude of the meniscus vibration cannot be controlled, whereby the flexibility in designing the ink-jet head is quite limited. As another method, there is a method (Japanese Patent Application Laid-Open No. 6-210872) in which pressure vibration is absorbed by providing a buffer chamber for keeping bubbles in a common fluid chamber.

Although this method is perfect as a means for suppressing the pressure vibration, flexibility is hardly left in the volume and form of the buffer since the buffer is provided in the common fluid chamber. Further, since bubbles are present in the vicinity of nozzles, the growth of the bubbles increase the possibility of the occurrence of an ink discharge failure.

The present invention has been invented to solve the above problems. It is an object of the present invention to provide an ink-jet recording head which suppresses unstable ink discharge caused by the vibration of ink which occurs when the ink is discharged, and a printing apparatus using the ink-jet recording head.

SUMMARY OF THE INVENTION

To achieve the above object, the present invention proposes an ink-jet recording head comprising a printing head unit which has one or more discharge portions for discharging one or more types of fluids for printing, a tank holder unit in which one or more tanks for storing one or more types of fluids to be discharged by the printing head unit are loaded, and a fluid supply path which is formed in the tank holder unit and communicates with the printing head unit and the tank, wherein a buffer chamber for keeping gas is connected to the fluid supply path.

The above fluid supply path and the above buffer chamber are preferably formed by joining one or more supply path-forming members to the above tank holder unit.

Further, the above fluid supply path is preferably formed in the direction perpendicular to the direction of gravity.

Still Further, the flow path which connects the above buffer chamber to the above fluid supply path is preferably disposed at an angle of at least 90° from the direction in which a fluid is headed from the tank toward the discharge portion.

Still Further, the cross section of the flow path which connects the above buffer chamber to the above fluid supply path is preferably smaller than that of the buffer chamber.

In addition, the inner wall of the above buffer chamber is preferably made water-repellent.

In the above printing head, the above discharge portion preferably has a flow path which communicates with a discharge port for discharging a fluid, a thermal energy-generating element which is provided along with the flow path and generates thermal energy for discharging a fluid, and a common fluid chamber for supplying a fluid to the above flow path.

Further, the present invention also proposes a printing apparatus using the above ink-jet recording head, which discharges droplets from discharge portions toward a printing medium to do printing.

According to the above constitutions, in the ink-jet recording head in which the fluid supply path which communicates with the tank and the discharge portions for discharging the fluid in the tank is formed by joining the printing head unit having the discharge portions to the tank holder unit and the printing apparatus using the head, by connecting the buffer chamber for keeping gas to the above fluid supply path, the vibration of the pressure in the flow path due to the vibration of the ink at the time of discharging the ink can be suppressed, a stable discharge state can be maintained, and an image of high quality can always be obtained.

DETAILED DESCRIPTION OF THE PREFERRED EMBODIMENTS

A description will be given to the embodiments of the present invention with reference to drawings hereinafter.

First Embodiment

Figure 1:
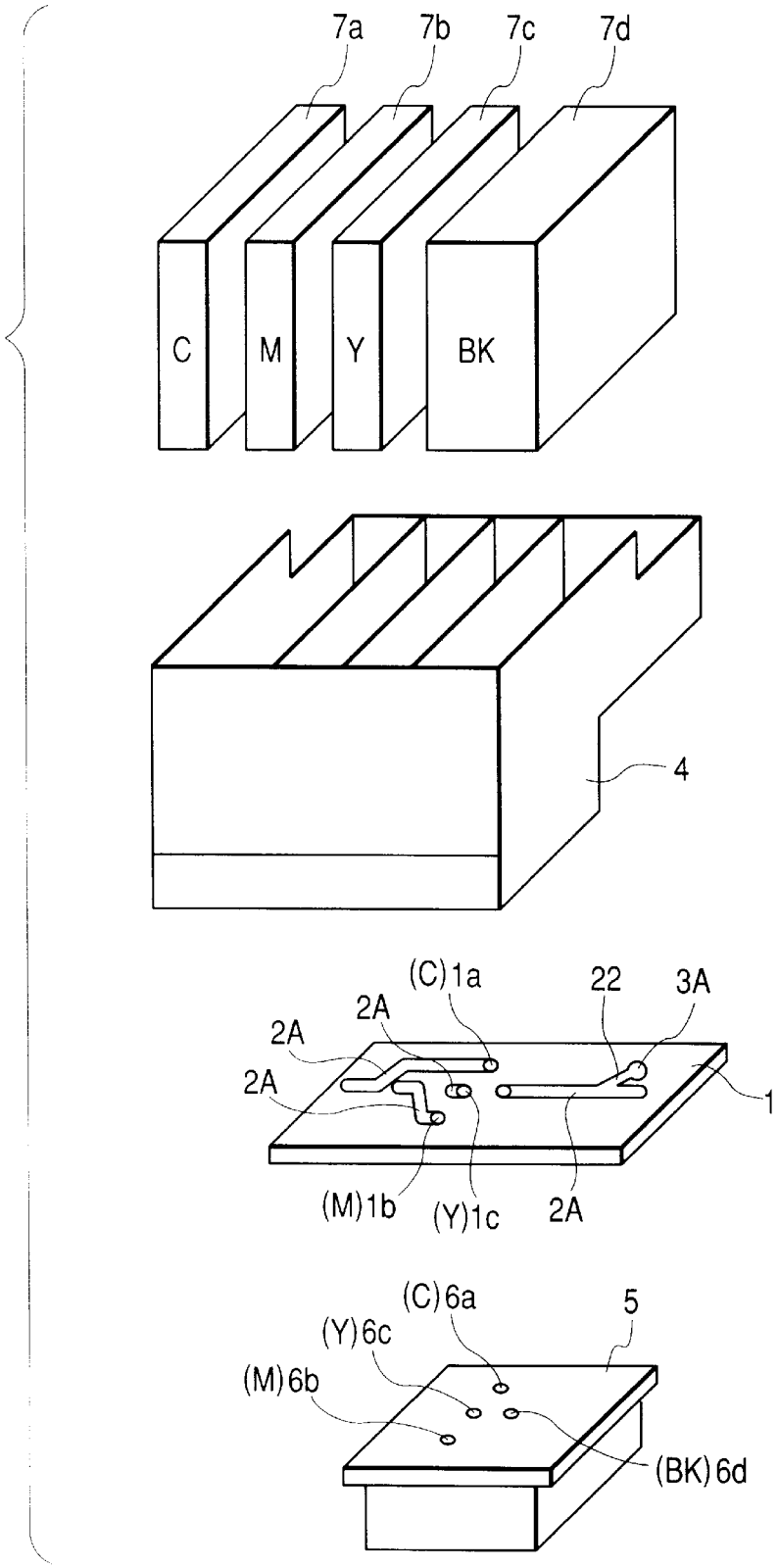
FIG. 1 is a schematic diagram showing a first embodiment of the ink-jet recording head of the present invention.
Figure 2:
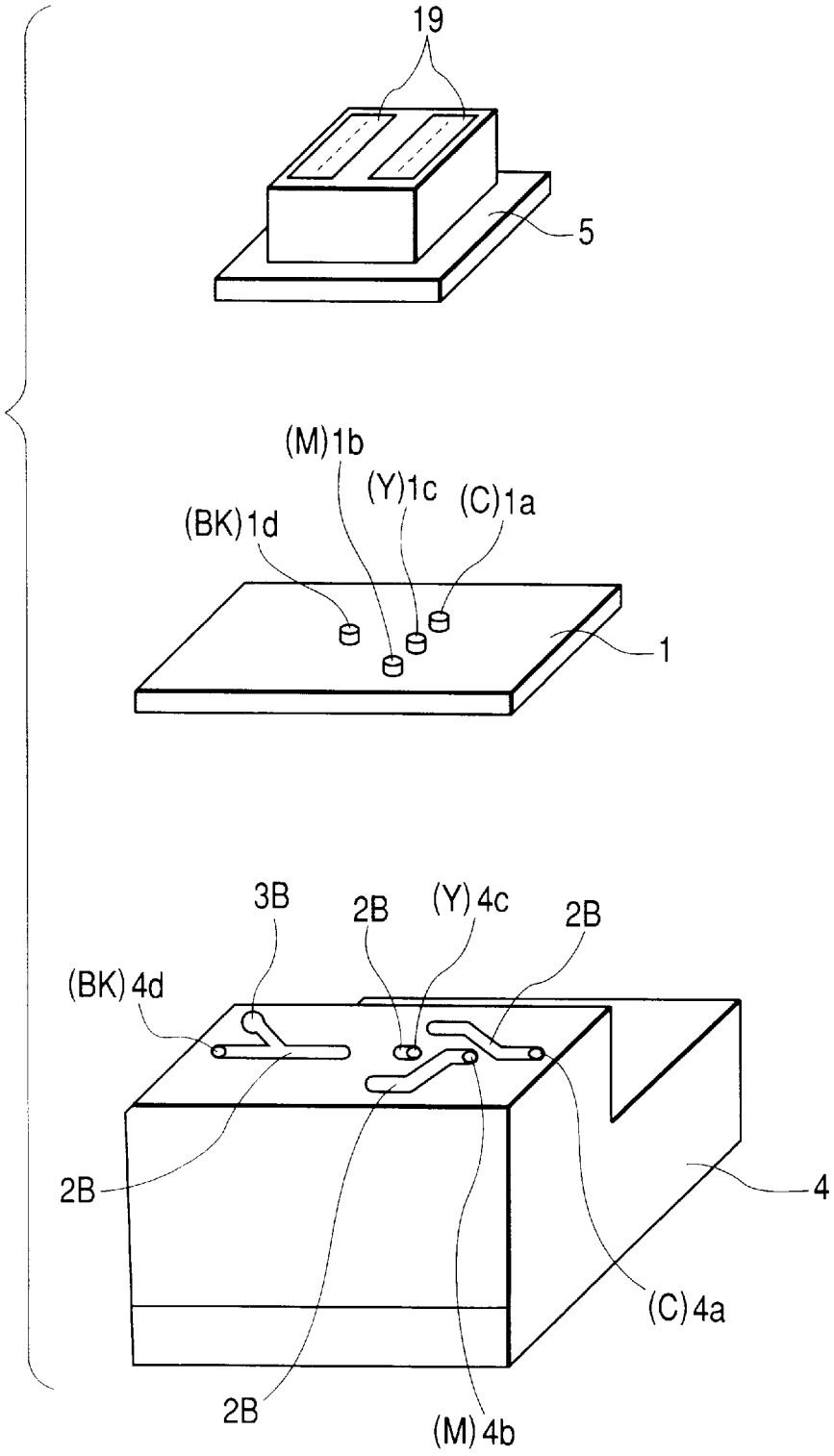
FIG. 2 is a schematic diagram showing the embodiment of the ink-jet recording head shown in FIG. 1 when it is viewed from the side thereof where it has discharge ports.

FIGS. 1 and 2 are exploded perspective views which schematically show a printing head cartridge which is a first embodiment of the ink-jet recording head of the present invention. Particularly, FIG. 1 is a view of the cartridge on the side thereof from which tanks are loaded into the cartridge, and FIG. 2 is a view of the discharge ports of the cartridge.

The head cartridge 1 of the embodiment shown in FIGS. 1 and 2 comprises a printing head unit 5 which has two ink discharge portions 19 one of which is for three colors, i.e., cyan (C), magenta (M) and yellow (Y), and the other of which is for black (Bk), separate ink tanks 7*a*, 7*b*, 7*c* and 7*d* for four colors (C, M, Y and Bk), a tank holder unit 4 into which the tanks 7*a* to 7*d* are loaded, and a flow path-forming member 1 for forming ink supply paths which connect the loaded ink tanks 7*a* to 7*d* to their corresponding ink discharge portions 19.

On the surfaces of the flow path-forming member 1 and the tank holder unit 4 on which they are joined to each other, grooves 2A and 2B for ink supply paths and grooves 3A and 3B for a buffer chamber are engraved, respectively. When the flow path-forming member 1 and the tank holder unit 4 are joined together, the grooves 2A and 2B for ink supply paths together form tubular ink supply paths, and the grooves 3A and 3B for a buffer chamber together form a buffer chamber. The buffer chamber is a chamber (space) which is branched out from the ink supply path and provided for keeping gas for absorbing ink vibration. In the grooves 2B for the ink supply paths provided on the surface of the tank holder unit 4 on which the tank holder unit 4 is joined to the flow path-forming member 1, a fluid outlet (C) 4*a*, a fluid outlet (M) 4*b*, a fluid outlet (Y) 4*c* and a fluid outlet (Bk) 4*d* for ejecting the ink stored in the tank of each color (C, M, Y and Bk) loaded in the tank holder unit 4 from the tank are formed.

When the flow path-forming member 1 and the tank holder unit 4 are to be joined together, they must be joined together such that no leaks would occur around the perimeters of the ink supply paths and the buffer chamber. In the present invention, they are welded together by means of ultrasound by providing welding ribs (refer to FIG. 4) along the grooves 2A for the ink supply paths and groove 3A for the buffer chamber of the flow path-forming member 1. Thereby, the permeability of gas to the ink supply paths and buffer chamber can be held lower than when the perimeters of the ink supply paths and the buffer chamber are sealed by a silicon sealant or the like, and the occurrence of ink ejection failure due to the bubbles entered the ink supply paths by the growth of gas can be prevented. Actually, in the test of the present embodiment in which the flow path-forming member 1 and tank holder unit 4 joined together are left to stand in a 35/dry environment for 72 hours, the growth of gas blocking the ink supply paths has not been observed.

Further, the flow path-forming member 1 and the printing head unit 5 each have fluid supply ports. The fluid supply ports of the printing head unit 5 are a fluid supply port (C) 6*a*, a fluid supply port (M) 6*b* and a fluid supply port (Y) 6*c* which are connected to the corresponding separate common fluid chambers (not shown) in the ink discharge portion which discharges the three colors (C/M/Y) and a fluid supply port (Bk) 6*d* which is connected to the common fluid chamber in the ink discharge portion which discharges black (Bk). Meanwhile, the fluid supply ports of the flow path-forming member 1 are a fluid supply port (C) 1*a*, a fluid supply port (M) 1*b*, a fluid supply port (Y) 1*c* and a fluid supply port (Bk) 1*d* which correspond to the fluid supply ports 6*a* to 6*d* of the printing head unit 5.

With the tank holder unit 4, the flow path-forming member 1 and the printing head unit 5 joined together, the cyan ink in the cyan ink tank 7*a* can be supplied to the cyan common fluid chamber in the ink discharge portion for the three colors by going through the fluid outlet (C) 4*a* of the tank holder unit 4, the fluid supply port (C) 1*a* of the flow path-forming member 1, the cyan ink supply path and the fluid supply port (C) 6*a* of the printing head unit 5. As for other tanks 7*b* to 7*d*, similarly, an independent path for supplying the ink in a given tank to the common fluid chamber of the ink discharge portion which discharges the ink in the tank is formed for each of the remaining colors.

Although FIGS. 1 and 2 show only one buffer chamber branched out of and connected to the ink supply path which communicates with the fluid outlet 4*d* for black ink in order to simplify the drawings, a buffer chamber is also provided to the ink supply path for each of other C, M and Y inks.

Figure 3:
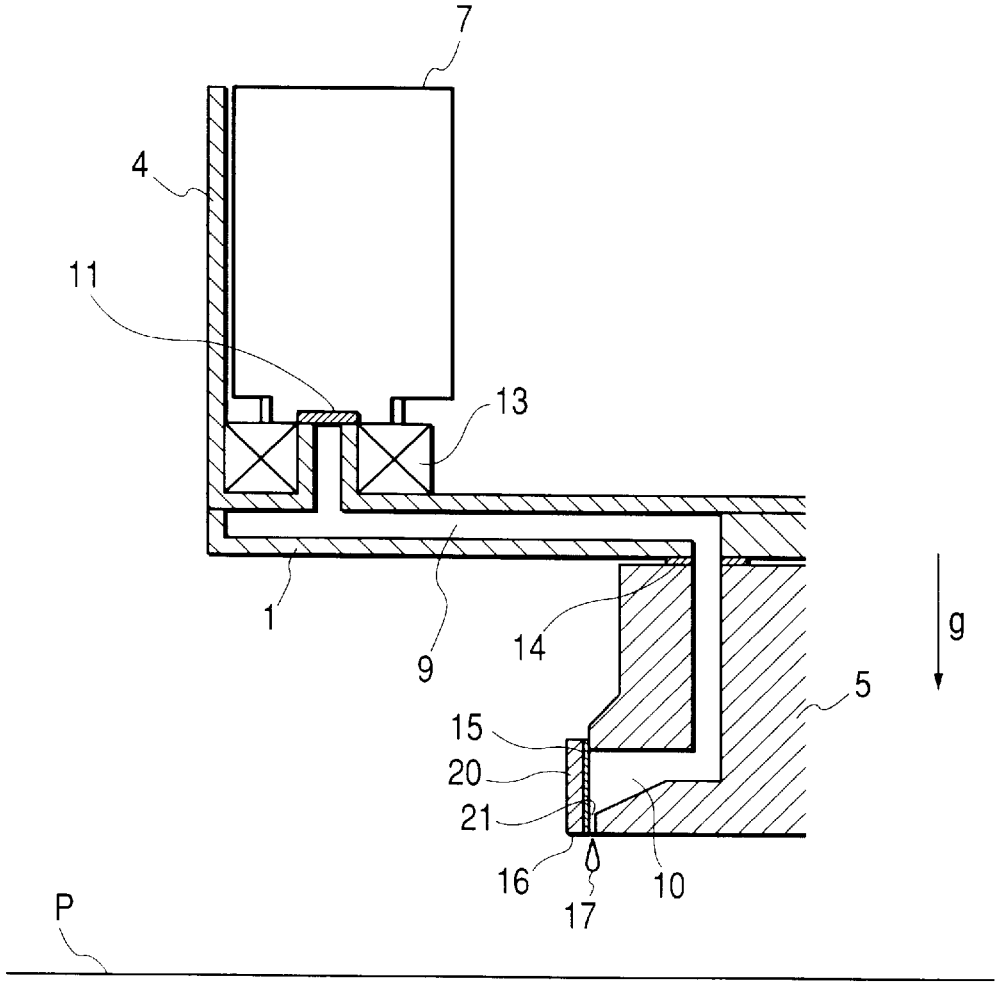
FIG. 3 is a schematic cross-sectional diagram showing the embodiment of the ink-jet recording head shown in FIGS. 1 and 2.

FIG. 3 is a schematic cross-sectional diagram showing an example of an ink supply path provided in an ink supply system comprising a tank applicable to the present invention, a tank holder unit and a channel-forming member and a printing head unit. The ink from an ink tank 7 passes through an ink supply path 9 via a filter 11 and is supplied to a common fluid chamber 10. FIG. 3 is not a cross-sectional view of the assembly of the components shown in FIGS. 1 and 2 and only schematically shows the ink supply path formed according to the constitution of the present invention and extending from the tank to the common fluid chamber. Reference numeral 20 denotes a heater board obtained by forming a heating resistive element (heater for discharge) 16 as a discharge energy-generating element on a substrate by using a semiconductor process. The ink supplied to the common fluid chamber 10 passes through an ink flow path 21 provided along with the heater 16 and is discharged from a discharge port by the pressure wave of bubbles caused by the film boiling by the heating resistive element 16.

Further, in the present embodiment, a printing apparatus is adopted that prints an image on printing paper P by discharging ink droplets from a printing head unit 5 located above the printing paper P roughly in the direction of gravity as shown in FIG. 3. The ink supply path 9 which is formed by joining the flow path-forming member 1 to a tank holder unit 4 and a communicating channel which communicates with the ink supply path 9 and a buffer chamber are provided in the direction (horizontal direction) perpendicular to the direction of gravity (g). Thereby, the suppression of ink vibration by the buffer chamber can be achieved without considering the influence of gravity components. However, although an embodiment of the printing apparatus that does printing by discharging ink droplets from the printing head unit 5 roughly in the direction of gravity has been illustrated with reference to FIG. 3, it is satisfactory in the present invention that at least the buffer chamber and the communicating channel which communicates with the buffer chamber and the ink supply path 9 are formed in a horizontal direction at the time of printing, and the direction in which the printing droplets are discharged may cross the direction of gravity.

Figure 4:
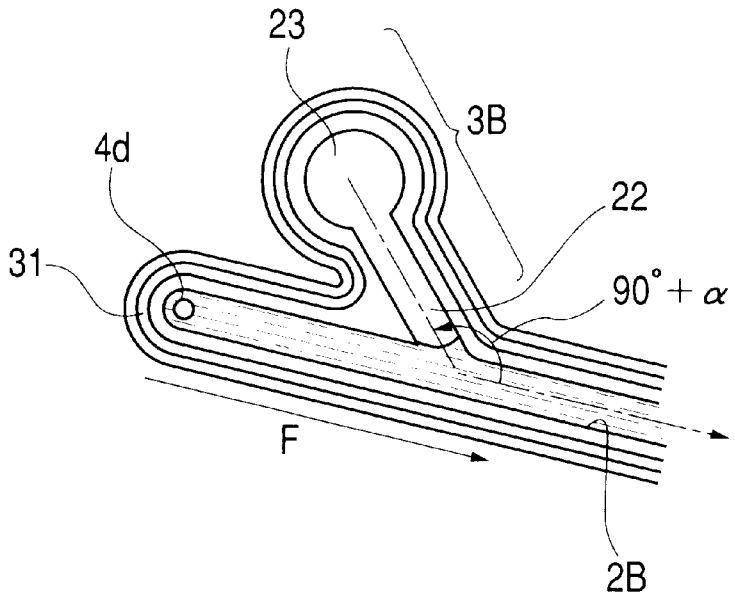
FIG. 4 is an enlarged view of the buffer chamber shown in FIGS. 1 and 2.

FIG. 4 is an enlarged view of the periphery of the groove 3B for the buffer chamber which communicates with the groove 2B for the ink supply path in which the fluid outlet (Bk) 4*d* shown in FIG. 2 is formed as an example to describe the above buffer chamber shown in FIG. 4 in more detail. In FIG. 4, the arrow F indicates the direction of the flow of ink at the time of discharging the ink. Referring to FIG. 4, the groove 3B for the buffer chamber on the surface of the tank holder unit 4 on which the tank holder unit 4 is joined to the flow path-forming member 1 is communicated with the groove 2B for the ink supply path by a communicating channel 22. Likewise, as shown in FIG. 1, the groove 3A for the buffer chamber on the surface of the flow path-forming member 1 on which the flow path-forming member 1 is joined to the tank holder unit 4 is communicated with the groove 2A for the ink supply path by the communicating channel 22. Further, on the surfaces of the tank holder unit 4 and the flow path-forming member 1 on which they are joined to each other, surface portions (welding surface portions) having welding ribs 31 are provided around the grooves for the ink supply paths, the grooves for the buffer chamber and the communicating channel.

Next, a description will be given specifically to FIG. 4 hereinafter. The communicating flow path 22 is formed at an angle of at least 90° from the direction (the direction of the arrows in FIG. 4) in which ink flows when the ink is sucked and retrieved by the printing apparatus itself or when the ink is discharged to the printing head. Further, the groove 3B for the buffer chamber comprises a volume expanding portion 23 and the communicating flow path 22 and tapers down toward the groove 2B for the ink supply path. The cross-section of the communicating flow path 22 is preferably smaller than that of the buffer chamber. By this shape, it can be prevented in the head cartridge completed by connecting the flow path-forming member or the like that ink flows into the buffer chamber when the ink flows in the ink flow path and replaces the gas in the buffer chamber. When the angle was set to be 120° in the present embodiment, the gas in the buffer chamber was not replaced by ink when the ink is sucked by the printing apparatus itself or when the ink is discharged.

Figure 5:
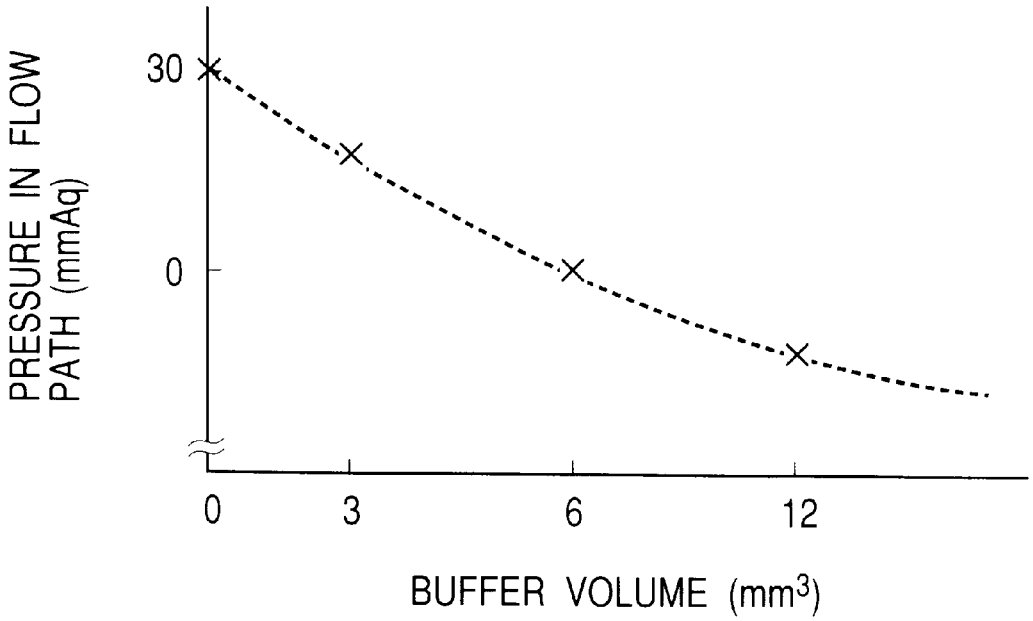
FIG. 5 is a graph showing the relationship between the buffer volume and the pressure in a flow path in the ink-jet recording head having a buffer chamber according to the present invention.

Further, the absorbency of ink vibration varies greatly according to the volume of existing gas. FIG. 5 is a graph showing the relationship between a buffer volume and the vibration amplitude of the pressure in a flow path which occurs when discharge is ceased. In this case, ink was discharged at a driving frequency of 18 kHz and a flow rate of about 9 g/min by using a 304 nozzle as a discharge nozzle. As is understood from this drawing, the vibration amplitude of the pressure in the flow path becomes smaller as the buffer volume increases. In general, when ink is not discharged (or when the holding power of meniscus at a nozzle and the negative pressure produced by the ink tank are balanced), a static negative pressure is exerted on the inside of the flow path by the negative pressure produced by the ink tank. The zero point in the pressure in the flow path in FIG. 5 is the point which indicates the boundary between the static negative pressure and a positive pressure in the flow path. When the internal pressure of the flow path is a positive pressure, meniscus protrudes from a nozzle, and when a print signal comes in at this point, deterioration in the quality of printing results. In the present embodiment, a good printing result could be obtained when the volume of the buffer chamber was 6 $mm^3$ or larger. However, the volume of the buffer chamber may be smaller than 6 $mm^3$ depending on the number of discharge nozzles in the head and the driving frequency. In the present embodiment, a large volume can be secured since the buffer chamber is provided in the flow path-forming member 1 and any shape can be selected freely without concerning the undercut at the time of production.

Further, since the buffer chamber is located away from the heater board which is a heat source, the gas in the buffer chamber is not affected by the heat caused by the driving of the heating resistive element. Therefore, desired performance can be maintained even when the quantity of heat is large and the amount of gas in the buffer chamber is large as in the case of a long head.

Figure 6:
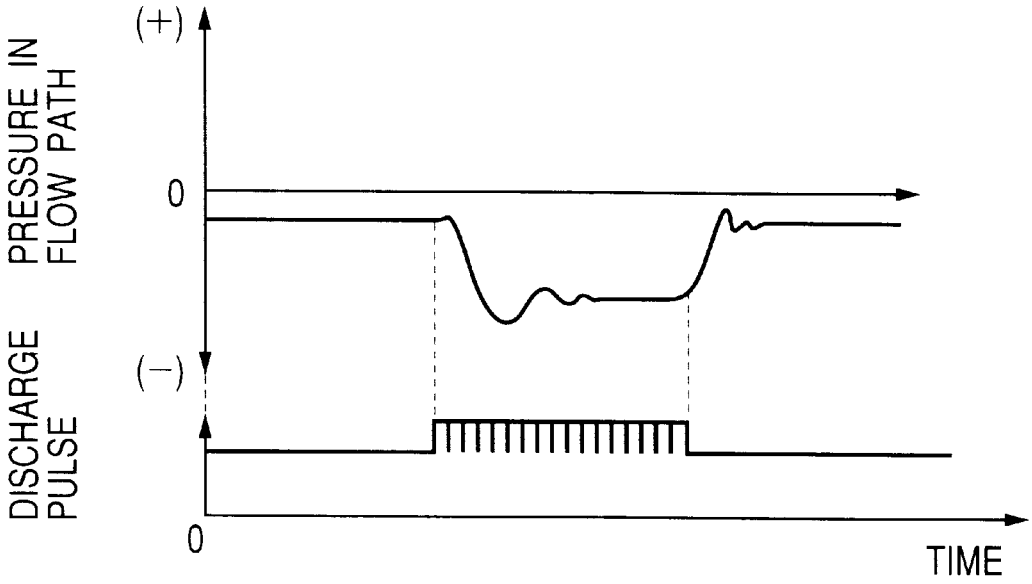
FIG. 6 is a graph showing the vibration waveform of the pressure in a flow path of the ink-jet recording head of the present invention.
Figure 12:
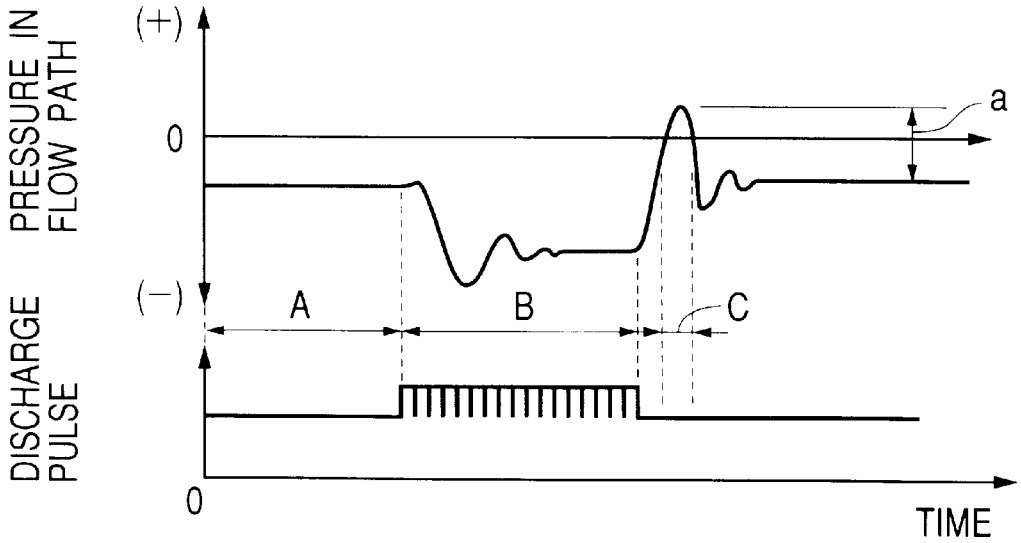
FIG. 12 is a graph showing the vibration waveform of the pressure in an ink flow path to a discharge pulse when a given discharge is made by a conventional ink-jet head.
Figure 13A:
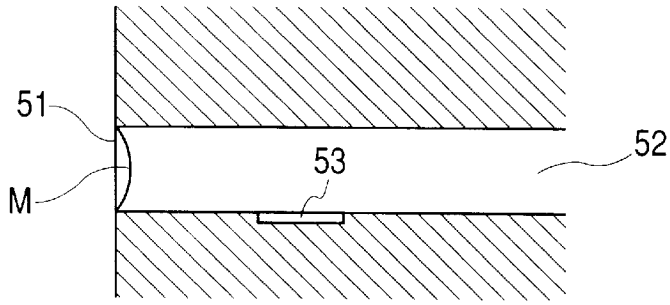
FIGS. 13A, 13B and 13C are cross-sectional views of a nozzle showing the states of meniscus in the section A (before discharge), the section B (during discharge) and the section C (immediately after discharge stop).
Figure 13B:
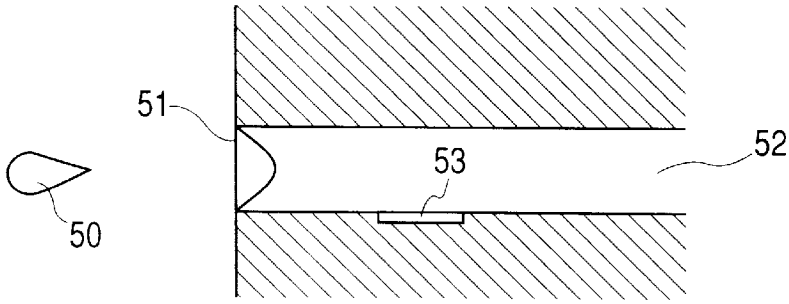
Figure 13C:
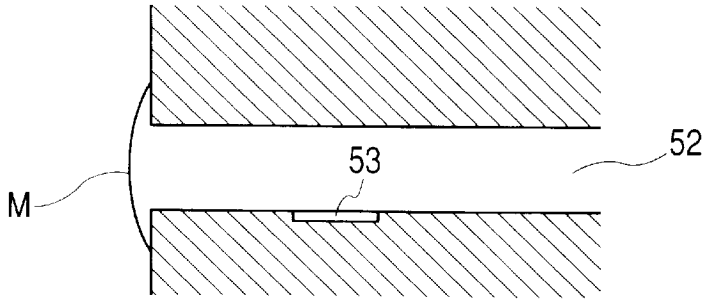

FIG. 6 is a schematic diagram showing the vibration waveform of the pressure in a flow path when the buffer chamber is provided with a volume of 12 $mm^3$ in the present embodiment. It is understood that the vibration amplitude of the pressure after the termination of printing is suppressed to a lower level than when the conventional head is used (refer to FIG. 12).

The gas in the buffer chamber dissolves in ink particularly at low temperatures. When this causes the gas in the buffer chamber to disappear and be completely replaced by th ink, ink vibration is not absorbed and meniscus vibration is greatly disturbed. Calculating from the solubility of air to water, the amount of the gas to be dissolved in the present embodiment is 3.4 $mm^3$ at 0° C. and 1 atm and the gas in the buffer chamber does not disappear. Actually, the gas in the buffer chamber did not disappear when stored at 5° C. for 360 hr, and good printing quality can still be attained even after the storage. Further, the retainability of the gas in the buffer chamber can be improved by subjecting the inner wall of the buffer chamber to water-repellant treatment to impart water-repellency to the inner wall.

Next, an example of the embodiment which is different from the above first embodiment will be presented, and a description will be given only to the differences between the two embodiments.

Second Embodiment

Figure 7:
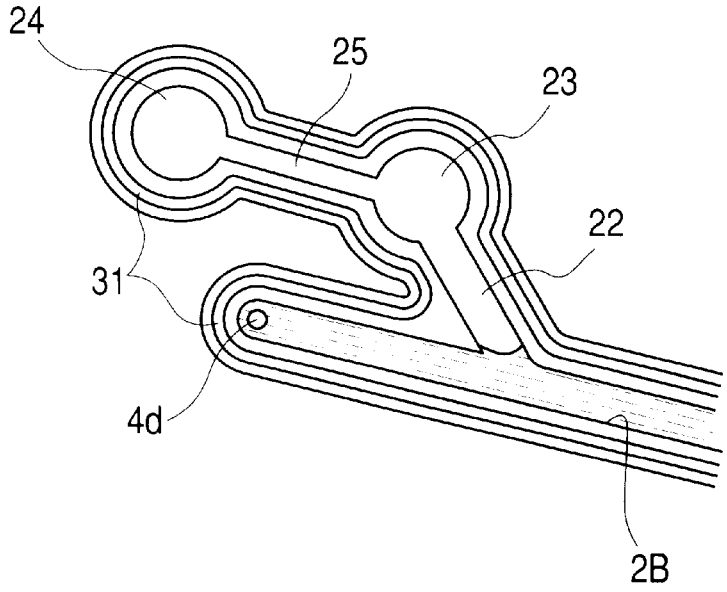
FIG. 7 is an enlarged view of the periphery of the buffer chamber according to a second embodiment of the ink-jet recording head of the present invention.

FIG. 7 is an enlarged view of the periphery of the buffer chamber according to a second embodiment of the ink-jet recording head of the present invention, and a description will be given only to the differences between the first embodiment and the second embodiment. Particularly, an example of the modification of the groove 3B for a buffer chamber shown in FIG. 4 is shown in FIG. 7. That is, the buffer chamber formed by joining the tank holder unit 4 to the flow path-forming member 1 has at least two volume-expanding portions 23 and 24, and the volume-expanding portions 23 and 24 and the groove 2B for the ink supply path are communicated with each other by communicating flow paths 22 and 25 which are narrower than the volume-expanding portions 23 and 24. Further, the welding ribs 31 are also formed around the volume-expanding portion 23 and the communicating flow path 25 in addition to the portions shown in FIG. 4. The cross-sections of the communicating flow paths 22 and 25 are preferably smaller than those of the volume-expanding portions 23 and 24 which constitute the buffer chamber. According to this constitution, it can be prevented by the influence of pressure loss in the communicating flow paths 22 and 25 that ink flows into the buffer chamber 23 and the gas in the buffer chamber disappear due to irregular decompression or vibration during the transportation of a finished head cartridge.

Third Embodiment

Figure 8:
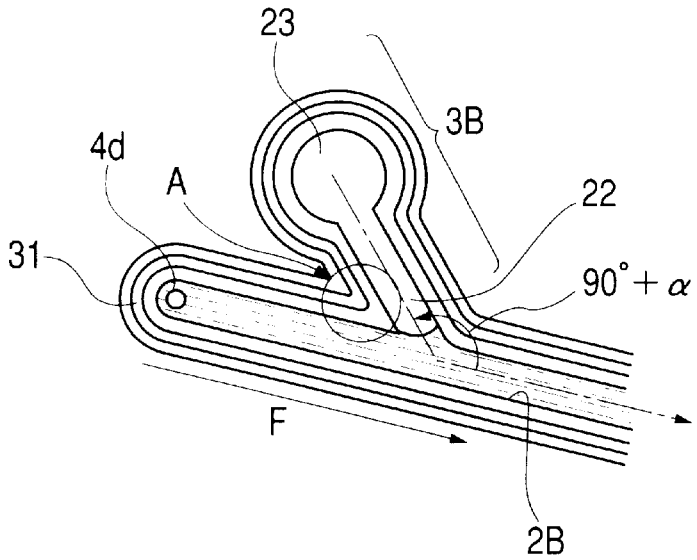
FIG. 8 is an enlarged view of the periphery of the buffer chamber according to a third embodiment of the ink-jet recording head of the present invention.

FIG. 8 is an enlarged view of the periphery of the buffer chamber according to a third embodiment of the present invention, and a description will be given only to the differences between the first embodiment and the third embodiment. In FIG. 8, the arrow F indicates the direction in which ink flows at the time of discharge.

As described in the first embodiment with reference to FIG. 4, by forming surface portions (welding surface portions) having the welding ribs 31 around the grooves for ink supply paths, the grooves for a buffer chamber and the communicating flow paths on the surfaces of the tank holder unit and the flow path-forming member on which they are joined to each other, the ink supply paths and buffer chamber which are formed by joining the grooves together by welding are sealed securely. In addition to this, in the present embodiment, the welding rib 31 at the point (indicated by circled portion A in FIG. 8) where the groove 2B for the ink supply path and the communicating flow path 22 branching from the groove 23 are connected to each other is formed closer to the groove 2B for the ink supply path and the communicating flow path 22 than that of the first embodiment, and the welding are inside of the welding rib 31 is reduced.

According to this embodiment, regardless of what position a finished head cartridge is in during transportation or storage, it can be prevented that ink flows into the buffer chamber 23 through the welding area inside of the welding rib 31 due to irregular vibration and shock and the gas in the buffer chamber disappears. Further, by applying the form like the portion A in FIG. 8 to the above second embodiment, the retainability of the gas in the buffer chamber can be further improved.

Fourth Embodiment

Figure 9:
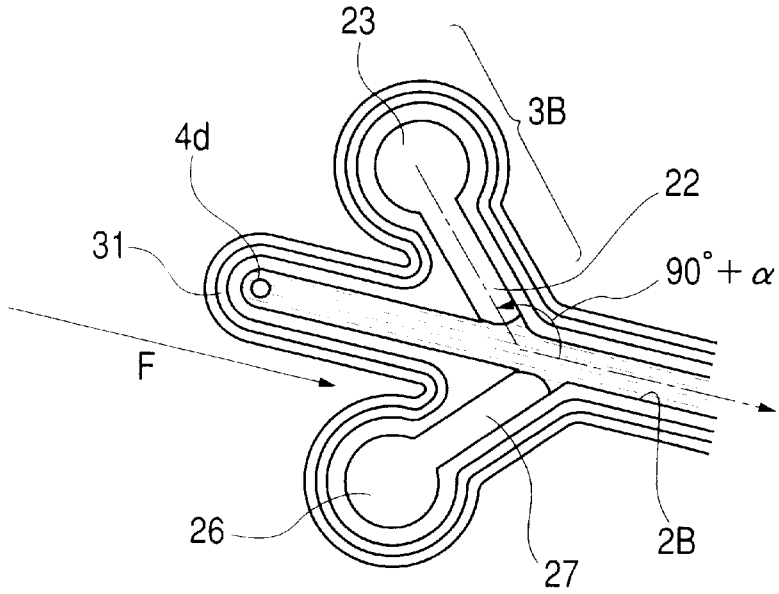
FIG. 9 is an enlarged view of the periphery of the buffer chamber according to a fourth embodiment of the ink-jet recording head of the present invention.

FIG. 9 is an enlarged view of the periphery of the buffer chamber according to a fourth embodiment of the present invention, and a description will be given only to the differences between the first embodiment and the fourth embodiment. In FIG. 8, the arrow F indicates the direction in which ink flows at the time of discharge.

The formation of the buffer chamber is not limited to only one side of the ink supply path as shown in FIGS. 4, 7 and 8. As specifically shown in FIG. 9, another chamber may be formed by providing another volume-expanding portion 26 on the side of the groove 2B for the ink supply path opposite to the side thereof to which the groove 3B for the buffer chamber is connected and connecting the volume-expanding portion 26 to the groove 2B for the ink supply path by the communicating flow path 27 which is narrower than the volume-expanding portion 26.

According to this embodiment, regardless of what position a finished head cartridge is in during transportation or storage, the incidence of disappearance of the gas in the buffer chamber which is caused by the ink flown into the buffer chamber due to irregular vibration and shock can be kept at a low level.

As a matter of course, the constitution in which one or more buffer chambers are formed on both sides of the ink supply path as in the present embodiment can be applied in combination with either or both of the embodiment of FIG. 7 and the embodiment of FIG. 8. Thereby, the retainability of the gas in the buffer chamber can be further improved. However, at least one of the communicating flow paths which communicate with the buffer chambers formed on both sides of the ink supply path must be formed at an angle of at least 90° from the direction in which ink flows when the ink is discharged from the printing head, and the angle of the other communicating flow path does not have to be the same as the above angle and should be set to be an optimum angle according to the manner in which the printing head is installed in the printing apparatus.

Fifth Embodiment

Figure 10:
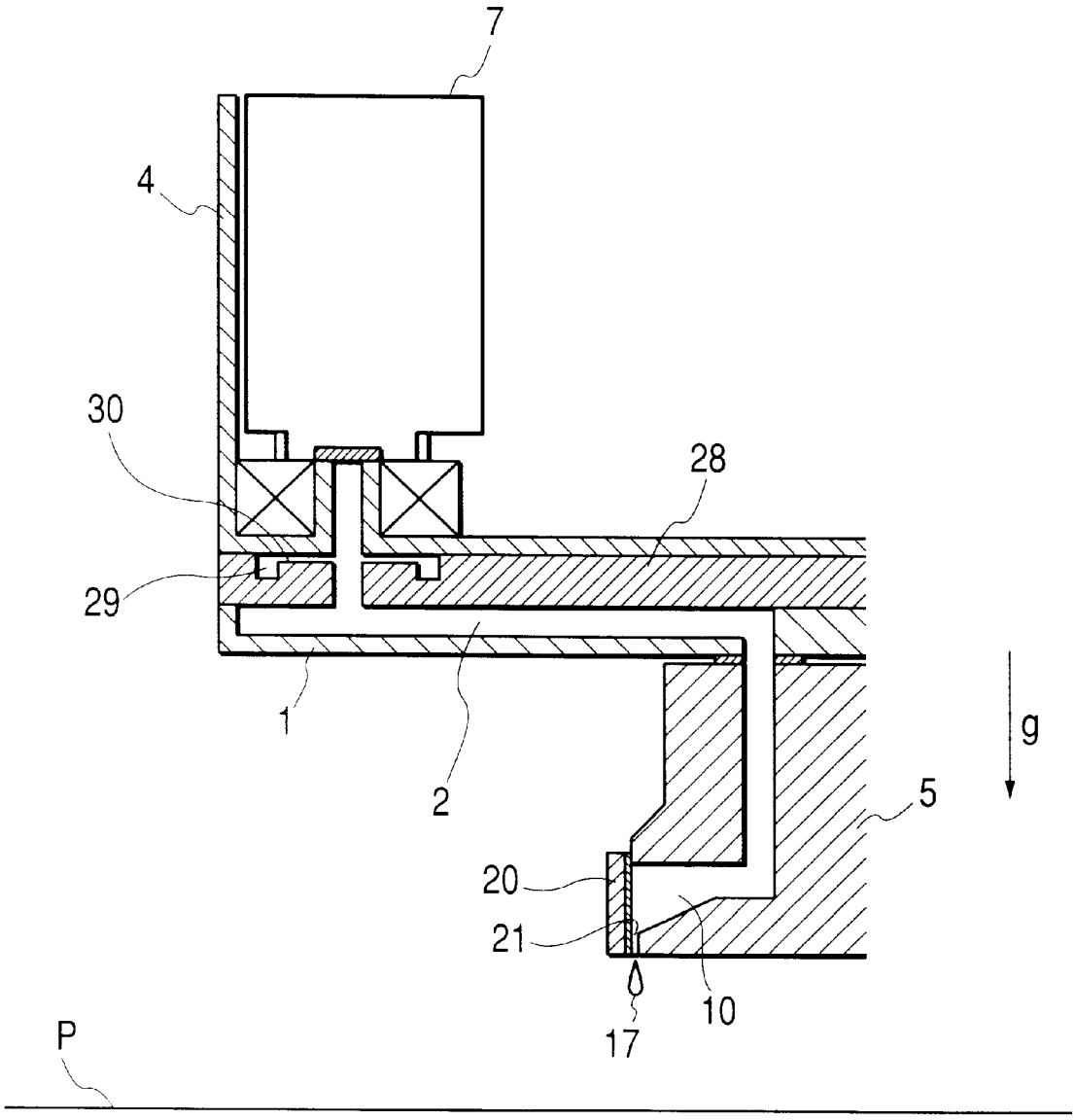
FIG. 10 is a schematic cross-sectional view of a fifth embodiment of the ink-jet recording head of the present invention.
Figure 11:
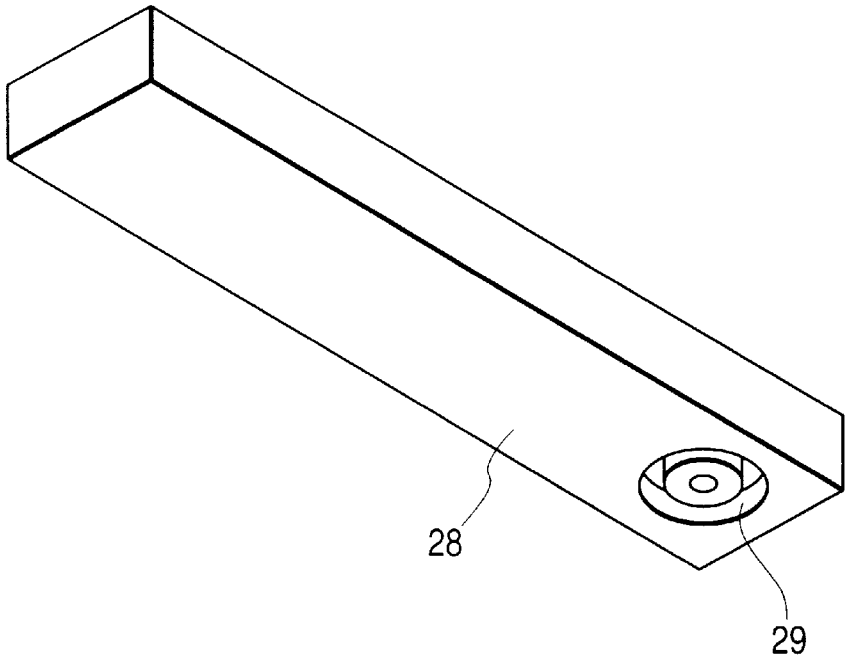
FIG. 11 is a schematic diagram showing the flow path-forming member provided with a buffer chamber in the ink-jet recording head shown in FIG. 10.

FIG. 10 is a schematic cross-sectional view of a fifth embodiment of the ink-jet recording head of the present invention. In FIG. 10, a reference numeral 28 indicates another flow path-forming member which is disposed between the flow path-forming member 1 and the holder unit 4, and this flow path-forming member 28 has buffer chambers 29 for keeping gas. FIG. 11 is a schematic perspective view of the flow path-forming member 28. The buffer chambers 29 are formed such that they taper down toward the ink supply path and have small clearances 30 under the tank holder unit 4. That is, the cross sections of the clearances 30 which are the communicating flow paths communicating with the buffer chambers and the ink supply path are sufficiently smaller than those of the buffer chambers 29. In this constitution, since ink seals the whole perimeters of the clearances 30 instantaneously, the gas in the buffer chambers 29 is not replaced by the ink, so that the gas can be retained in the chambers. In this case, the tank holder unit 4 and the flow path-forming member 28 must be joined together in order not to have leaks around the buffer chambers.

In the present embodiment, the flow path-forming member 28 was joined to the tank holder unit 4 by forming welding ribs around the buffer chambers 29 and welding these welding ribs by means of ultrasound. In this constitution, when the buffer chambers for keeping gas cannot be provided parallel to the ink supply path 2 due to a matter of space or the like, the buffer chambers can be provided by the adjustment in a vertical direction and the size of the head can be reduced advantageously. By combining such an embodiment with each of the above first to fifth embodiments as appropriate, the flexibility in providing the buffer chamber to the ink supply path between the printing head unit and the tank holder unit is increased.

As described above, according to the present invention, in the ink-jet recording head in which the fluid supply path which communicates with the tank and the discharge portions for discharging the fluid in the tank is formed by joining the printing head unit having the discharge portions to the tank holder unit and the printing apparatus using the head, by connecting the buffer chamber for keeping gas to the above fluid supply path, the vibration of the pressure in the flow path due to the vibration of the ink at the time of discharging the ink can be suppressed, a stable discharge state can be maintained, and an image of high quality can always be obtained.

Further, by forming the above fluid supply path and the above buffer chamber by joining the above tank holder unit to one or more supply path-forming members, the flexibility in designing the shape of the fluid supply path or the buffer chamber or in determining the position of the fluid supply path or the buffer chamber is increased.

Still further, by disposing the above fluid supply path in the direction perpendicular to the direction of gravity, the suppression of ink vibration by the buffer chamber can be achieved without considering the influence of gravity components.

Still further, by disposing the flow path which connects the above buffer chamber to the above fluid supply path at an angle of at least 90° from the direction in which a fluid is headed from the tank toward the discharge portion, it can be prevented that ink flows into the buffer chamber when the ink flows in the ink supply path and replaces the gas in the buffer chamber. In addition, when the cross section of the flow path which connects the above buffer chamber to the above fluid supply path is smaller than that of the above buffer chamber, the disappearance of the gas in the buffer chamber can be prevented more effectively. Further, by subjecting the inner wall of the above buffer chamber to water-repellent treatment, the retainability of the gas in the buffer chamber can be improved.

What is claimed is:

1. An ink-jet recording head comprising:

a printing head unit which has one or more discharge portions for discharging one or more types of fluids for printing, a tank holder unit in which one or more tanks for storing one or more types of fluids to be discharged by the printing head unit are loaded, and a fluid supply path which is formed in the tank holder unit and communicates with the printing head unit and the tank, wherein a buffer chamber for keeping gas is connected to the fluid supply path.

2. The head of claim 1, wherein the fluid supply path and the buffer chamber are formed by joining one or more supply path-forming members to the tank holder unit.

3. The head of claim 1, wherein a flow path which connects the buffer chamber to the fluid supply path is formed in the direction perpendicular to the direction of gravity.

4. The head of claim 1, wherein at least one flow path which connects the buffer chamber to the fluid supply path is disposed at an angle of at least 90° from the direction in which a fluid is headed from the tank toward the discharge portion.

5. The head of claim 1, wherein the cross section of the flow path which connects the buffer chamber to the fluid supply path is smaller than that of the buffer chamber.

6. The head of claim 1, wherein the inner wall of the buffer chamber is made water-repellent.

7. The head of claim 1, wherein the discharge portion has a flow path which communicates with a discharge port for discharging a fluid, a thermal energy-generating element which is provided along with the flow path for generating thermal energy for discharging a fluid, and a common fluid chamber for supplying a fluid to the flow path.

8. A printing apparatus using the ink-jet recording head of any one of claims 1 to 7 to discharge droplets from discharge portions toward a printing medium to perform printing.

* * * * *